United States Patent [19]

Sugawara et al.

[11] Patent Number: 4,585,177

[45] Date of Patent: Apr. 29, 1986

[54] FLUID DEFLECTING ASSEMBLY

[75] Inventors: Norio Sugawara; Motoyuki Nawa, both of Nara, Japan

[73] Assignee: Matsushita Electric Industrial Co., Ltd., Osaka, Japan

[21] Appl. No.: 634,712

[22] Filed: Jul. 26, 1984

[30] Foreign Application Priority Data

| | | | |
|---|---|---|---|
| Jul. 26, 1983 | [JP] | Japan | 58-136995 |
| Aug. 11, 1983 | [JP] | Japan | 58-147723 |
| Jan. 25, 1984 | [JP] | Japan | 59-12319 |
| Apr. 9, 1984 | [JP] | Japan | 59-70271 |

[51] Int. Cl.[4] ..... B60H 1/34; F24F 7/00

[52] U.S. Cl. ..... 239/590; 239/590.5; 98/2; 98/40.18

[58] Field of Search ..... 239/553, 589, 590, 590.3, 239/590.5, 597, 598, DIG. 7, 592; 98/2, 40 V, 40 N, 40 E, 40.18, 40.3

[56] References Cited

U.S. PATENT DOCUMENTS

| | | | |
|---|---|---|---|
| 1,170,807 | 2/1916 | Egan | 239/590 X |
| 4,266,722 | 5/1981 | Nawa et al. | 239/DIG. 7 X |

FOREIGN PATENT DOCUMENTS

| | | | |
|---|---|---|---|
| 33958 | 3/1980 | Japan | 239/590.5 |
| 33959 | 3/1980 | Japan | 239/590.5 |
| 61532 | 5/1981 | Japan | 98/40.18 |
| 20839 | 2/1983 | Japan . | |
| 33046 | 2/1983 | Japan | 98/40 N |

*Primary Examiner*—Joseph F. Peters, Jr.
*Assistant Examiner*—Mary Beth O. Jones
*Attorney, Agent, or Firm*—Pollock, Vande Sande & Priddy

[57] ABSTRACT

A fluid deflecting assembly is disclosed primarily for use in an outlet port of an air conditioning unit for controlling the direction of an air flow discharged from the outlet port. The fluid deflecting assembly comprises a tubular body having a flow passage for passing a fluid flow axially therethrough, a nozzle body mounted on the tubular body and having a nozzle disposed downstream of the flow passage in a direction of the fluid flow, a restriction surface extending downstream of the flow passage in surrounding relation to the nozzle, and a guide wall surface extending downstream of the nozzle and flaring radially outwardly from the nozzle in surrounding relation thereto, and a bias flow shield disposed in the flow passage upstream of and radially outwardly of the nozzle for adjustably blocking a portion of a bias fluid flow directed by the restriction surface toward the nozzle. A fluid flow discharged out of the nozzle is deflected by the bias fluid flow as modified by the bias flow shield so as to be attached to the guide wall surface. The discharged fluid flow can be deflected in desired three-dimensional directions through a wide angle by rotating and/or axially moving the bias flow shield.

14 Claims, 13 Drawing Figures

FLUID DEFLECTING ASSEMBLY

BACKGROUND OF THE INVENTION

The present invention relates to a fluid deflecting assembly for use in an outlet port of an air conditioning unit or the like for deflecting a discharged fluid flow in a desired direction.

Air conditioning units for cooling and warming limited spaces should preferably have means for directing a discharged cool air flow horizontally and a discharged warm air flow downwardly so as to achieve a uniform temperature distribution within the air-conditioned space. The air conditioning units should also be capable of deflecting a discharged air flow laterally in order to eliminate or reduce unwanted localized air flows resulting from certain positional limitations that the air conditioning units may suffer in actual installation.

One known fluid outlet construction or fluid deflecting assembly for use in air conditioning units is disclosed in Japanese Laid-Open Utility Model Publication No. 58-20839 published on Feb. 8, 1983. FIGS. 1 and 2 of the accompanying drawings illustrate the disclosed fluid outlet construction. The prior fluid outlet construction has a plurality of guide walls 1*a*, 1*b* (only two shown), a discharge nozzle 2, and a deflector plate 3 rotatable by a shaft 4. The deflector plate 3 serves to guide a fluid flow discharged from the nozzle 2 to get attached to and flow along one of the guide walls 1*a*, 1*b* (the guide wall 1*a* in the position of FIG. 1), thereby deflecting the fluid flow. The direction in which the fluid flow is discharged from the fluid outlet construction can be changed by rotating the deflector plate 3 to cause the fluid flow to flow along different guide walls. The prior fluid deflecting construction has been disadvantageous, however, in that the deflector plate 3 placed in the fluid flow presents a resistance to the fluid flow and is of such a shape as to disturb streamlines of the fluid flow, with the result that the fluid flow will not be well attached to the guide walls. Another problem is that the directions in which the fluid flow can be discharged from the outlet assembly are limited only to those along the guide walls; and, hence, the fluid flow cannot be directed perpendicularly to the nozzle.

SUMMARY OF THE INVENTION

It is an object of the present invention to provide a fluid deflecting assembly capable of deflecting a discharged fluid flow in various desired directions through a wide angle without disturbing steamlines of the fluid flow as it is deflected.

According to the present invention, a fluid deflecting assembly comprises a tubular body having a flow passage for passing a fluid flow axially therethrough, a nozzle body mounted on the tubular body and having a nozzle disposed downstream of the flow passage in a direction of the fluid flow, a restriction surface extending downstream of the flow passage in surrounding relation to the nozzle, and a guide wall surface extending downstream of the nozzle and flaring radially outwardly from the nozzle in surrounding relation thereto, and a bias flow shield disposed in the flow passage upstream of and radially outwardly of the nozzle for adjustably blocking a portion of a bias fluid flow directed by the restriction surface toward the nozzle. The bias flow shield modifies the bias fluid flow to control the direction of a fluid flow discharged from the nozzle without disturbing streamlines of the discharged fluid flow. The discharged fluid flow can be deflected in desired three-dimensional directions through a wide angle by rotating and/or axially moving the bias flow shield.

BRIEF DESCRIPTION OF THE DRAWINGS

The present invention will be described in detail by way of illustrative example with reference to the accompanying drawings, in which.

DETAILED DESCRIPTION

Figure 1:
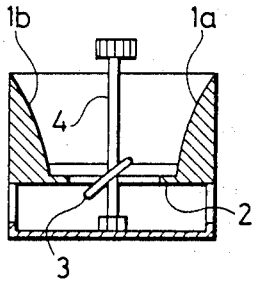
FIG. 1 PRIOR ART
FIGS. 1 and 2 are cross-sectional views of a conventional fluid deflecting assembly.
Figure 2:
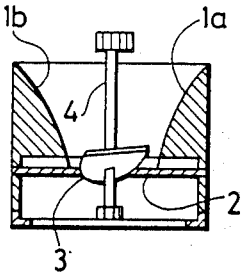
FIG. 2 PRIOR ART
Figure 3:
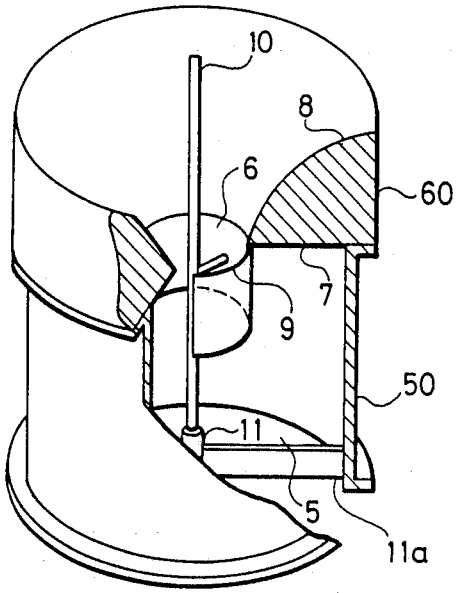
FIG. 3 is a perspective view, partly cut away, of a fluid deflecting assembly according to a first embodiment of the present invention.

Identical or corresponding parts are denoted by identical or corresponding reference characters throughout several views.

FIGS. 3 through 8 illustrate a fluid deflecting assembly constructed in accordance with a first embodiment of the present invention. The fluid deflecting assembly has a tubular body 50 defining therein a flow passage 5 for guiding therethrough a fluid or air flow from an air blower or the like, and a nozzle body 60 mounted on an axial end of the tubular body 50 and having a central circular nozzle 6 defined by a surrounding restriction surface 7 extending around a central axis 5*a* of the flow passage 5. The air flow is directed axially through the flow passage 5 and the nozzle 6. The nozzle body 60 also has a substantially conically tapered guide surface 8 disposed downstream of the nozzle 6 in surrounding relation thereto, the guide surface 8 progressively diverging or flaring radially outwardly away from the nozzle 6.

Figure 4:
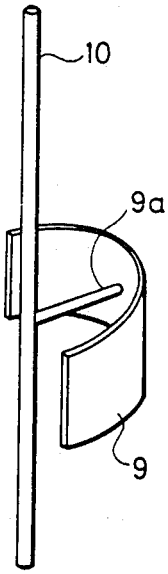
FIG. 4 is a perspective view of a bias flow shield in the fluid deflecting assembly shown in FIG. 3.

The fluid deflecting assembly also has an arcuate bias flow shield 9 disposed in the flow passage 5 immediately upstream of the nozzle 6 for blocking a bias air flow generated by the restriction surface 7. As shown in FIG. 4, the bias flow shield 9 is attached by a rod 9*a* to a rotatable shaft 10 extending coaxially through the tubular body 50 and the nozzle body 60. The arcuate bias flow shield 9 extends arcuately substantially along a portion of a circular edge of the nozzle body 60 which defines the circular nozzle 6. The shaft 10 is rotatable about its own axis and also movable axially. The shaft 10 is rotatably and axially movably supported by a bearing 11 positioned coaxially in the tubular body 50 by radial support arms 11*a*.

Figure 5:
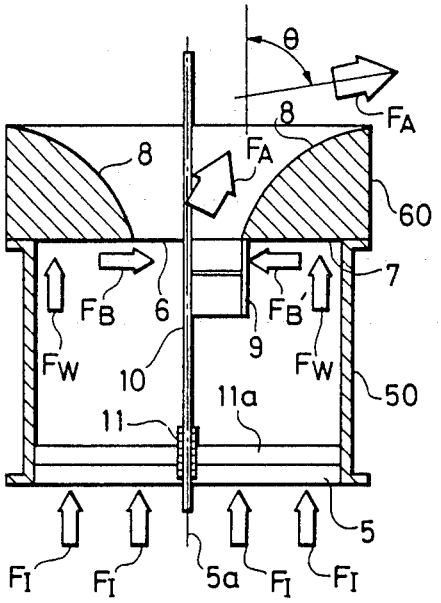
FIGS. 5 through 8 are longitudinal cross-sectional views of the fluid deflecting assembly illustrated in FIG. 3.

Operation of the fluid deflecting assembly thus constructed will be described with reference to FIGS. 5 through 8. In FIG. 5, the bias flow shield 9 is positioned in close contact with the nozzle 6. Air stream $F_I$ flow axially into the flow passage 5 and peripheral air streams $F_W$ having entered the flow passage 5 are directed by the restriction surface 7 to flow radially inwardly as bias flows. The bias flow $F_B$ positioned leftward (FIG. 5) of the bias flow shield 9 freely flows into the nozzle 6 and has the greatest flow-deflecting effect, but the bias flow $F_B'$ positioned rightward of the bias flow shield 9 is blocked thereby and has substantially no flow-deflecting effect. A main central air flow $F_A$ which goes through the nozzle 6 is therefore forced by the bias flow $F_B$ to be attached to a righthand portion of the guide wall surface 8, with the result that the main air flow $F_A$ is deflected to the right through a wide angle of $\theta$. The deflecting angle $\theta$ can be changed as desired by selecting an appropriate configuration of the guide wall surface 8.

Figure 6:
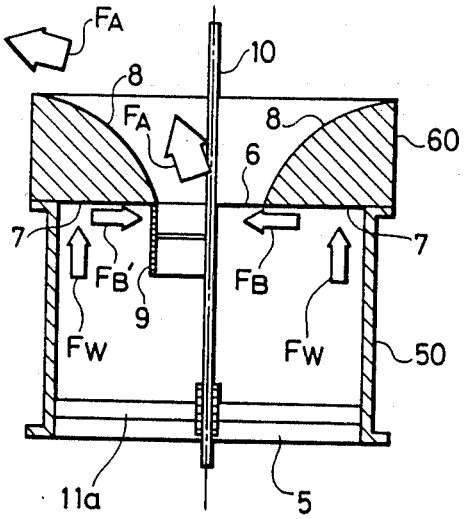

FIG. 6 shows the position in which the bias flow shield 9 has been turned by the shaft 10 therearound through 180° from the position of FIG. 5. With the bias flow shield 9 thus positioned, the main air flow $F_A$ is deflected to the left through a wide angle determined by the guide wall surface 8.

Figure 7:
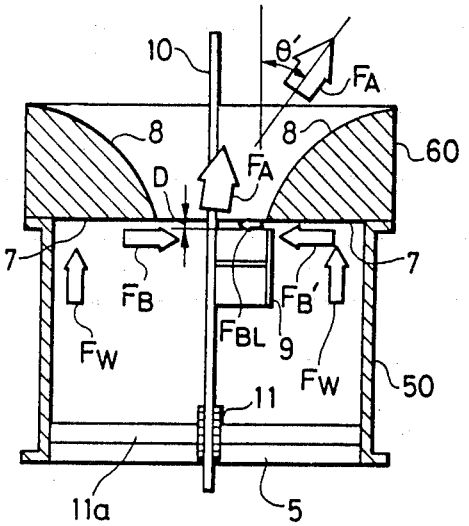

In FIG. 7, the bias flow shield 9 is in the angular position corresponding to that shown in FIG. 5, but is slightly lowered to provide a gap D between the restriction surface 7 and the bias flow shield 9. The gap D allows a portion of the air flow $F_B'$ to pass as an air flow $F_{BL}$ into the nozzle 6 so as to counter and, hence, weaken the bias air flow $F_B$ flowing into the nozzle 6. Therefore, a main air flow $F_A$ is less liable under the influence of the air flow $F_B$ to get attached to the guide wall surface 8, and is deflected through an angle $\theta'$ which is smaller than the angle $\theta$ (FIG. 6). The deflecting angle $\theta'$ is in inverse proportion to the gap D.

Figure 8:
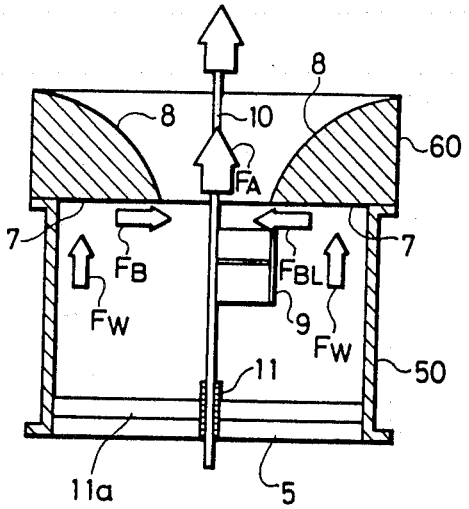

FIG. 8 shows the bias flow shield 9 which is lowered from the position of FIG. 7. At this point, there is a substantially wide gap between the bias flow shield 9 and the restriction surface 7 to allow a bias air flow $F_{BL}$ to pass through the gap into the nozzle 6. The bias air flow $F_{BL}$ is substantially equal in intensity to an opposite bias air flow $F_B$, so that a main flow $F_A$ will not be deflected but discharged straight out of the nozzle 6.

With the fluid deflecting assembly of the above construction, the air flow discharged from the nozzle body 60 can be three-dimensionally oriented in various desired directions simply by rotating and/or axially moving the bias flow shield 9 by means of the shaft 10.

Figure 9:
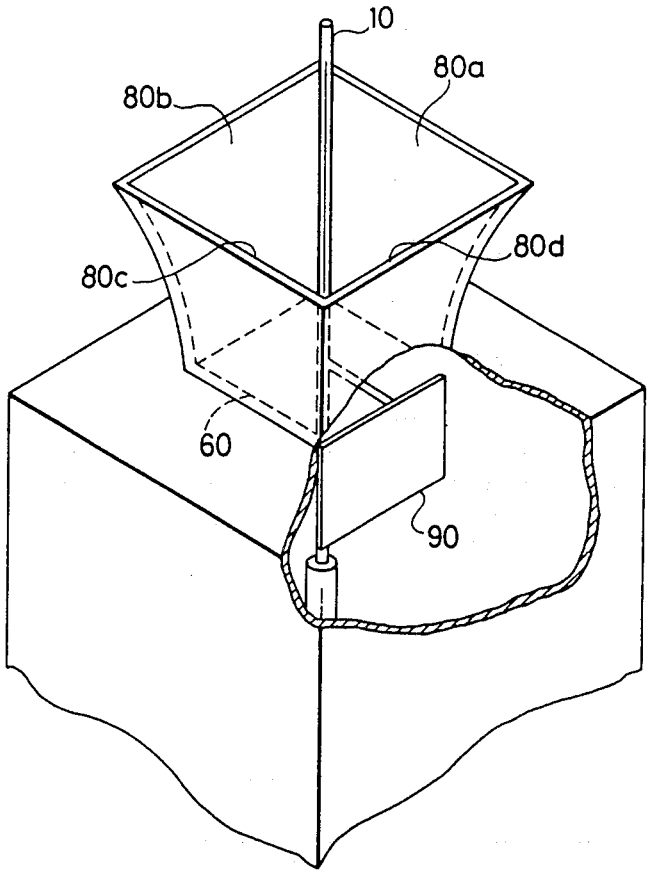
FIG. 9 is a perspective view, partly broken away, of a fluid deflecting assembly according to a second embodiment of the present invention.

FIG. 9 shows a second embodiment in which a nozzle 60 is of a polygonal shape (square in the illustrated embodiment) and outwardly flaring guide walls 80*a* through 80*d* are attached to and extend from the sides of the nozzle 60. A bias flow shield 90 is in the form of a flat plate positioned upstream of the nozzle 60 and rotatably and axially movably supported on a shaft 10 extending coaxially through the nozzle 60. By rotating the shaft 10 to bring the bias flow shield 90 into alignment with the sides of the nozzle 60, a discharged air flow coming out of the nozzle 60 changes its direction in a discrete steplike manner. The fluid deflecting assembly illustrated in FIG. 9 is therefore capable of discharging an air flow in predetermined distinct directions. The dicharged air flow goes straight out of the nozzle 60 when the bias flow shield 90 is moved away from the nozzle 60.

Figure 10:
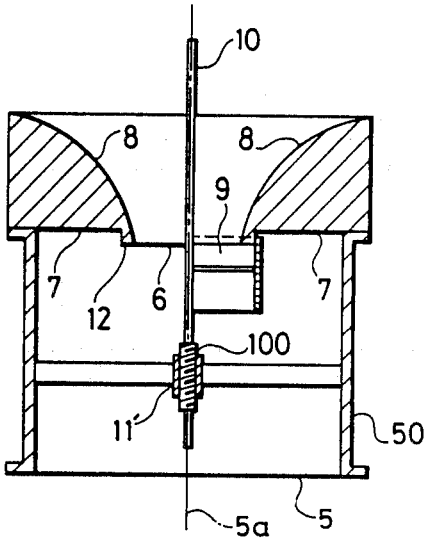
FIG. 10 is a longitudinal cross-sectional view of a fluid deflecting assembly according to a third embodiment of the present invention.

According to a third embodiment illustrated in FIG. 10, a restriction surface 7 has an annular flange 12 extending around a circular nozzle 6 and projecting upstream thereof, and an arcuate bias flow shield 9 is fitted over the annular flange 12 when the bias flow shield 9 is positioned closest to the nozzle 6 as shown. A rotatable shaft 10 has an externally threaded portion 100 threaded in a support 11'. When the annular flange 12 and the bias flow shield 9 are in fitting engagement, they prevent any air leakage flowing between the bias flow shield 9 and the restriction surface 7 from passing therebetween into the nozzle 6. Accordingly, in the position of FIG. 10, a discharged air flow is radially attached to the guide wall surface 8 and deflected through a large angle as no air leakage flows from the bias flow shield 9 into the nozzle 6. The threaded engagement of the rotatable shaft 10 with the support 11' causes the bias flow shield 9 to move axially in response to rotation of the shaft 10 and, hence, the bias flow shield 9. As a consequence, continued rotation of the shaft 10 results in a discharged air flow changing its direction in a spiral pattern. The discharged air flow can be oriented three-dimensionally in desired directions only by rotating the shaft 10. The annular flange 12 is of such a height that it will prevent air from flowing between the annular flange 12 and the bias flow shield 9 while the latter makes about one revolution after it has started leaving the restriction surface 7 or before it is about to contact the restriction surface 7. Therefore, the discharged air flow remains attached to the guide wall surface 8 and is deflected through the widest angle as long as the bias flow shield 9 makes one such revolution. When the shaft 10 is continuously rotated while the bias flow shield 9 is disengaged from the annular flange 12, the discharged air flow turns spirally radially inwardly toward a central axis of fluid deflecting assembly at the time the bias flow shield 9 moves away from the nozzle 6, or radially outwardly from the central axis of fluid deflecting assembly at the time the bias flow shield 9 moves toward the nozzle 6.

Figure 10A:
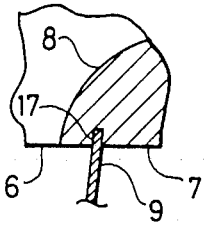
FIG. 10A is a fragmentary cross-sectional view showing a modification.

FIG. 10A illustrates a modification in which the restriction surface 7 has an annular groove 17 defined therein radially outwardly of the nozzle 6 for receiving a downstream edge of the bias flow shield 9. The bias flow shield 9 with its downstream edge fitted in the annular groove 17 completely blocks a bias air flow.

Figure 11:
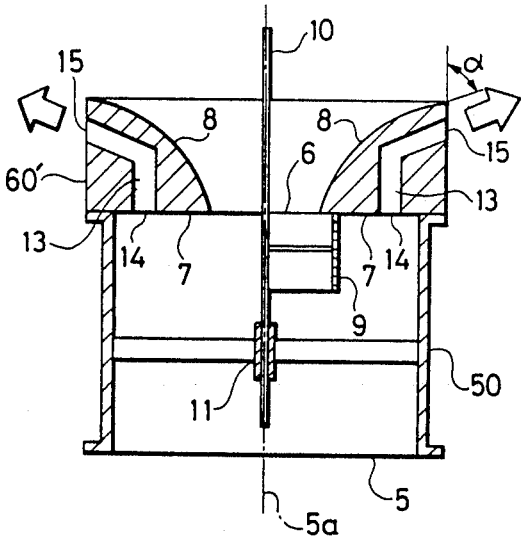
FIG. 11 is a longitudinal cross-sectional view of a fluid deflecting assembly according to a fourth embodiment of the present invention.

FIG. 11 is illustrative of a fluid deflecting assembly according to a fourth embodiment of the present invention. A nozzle body 60' has auxiliary discharge passages 13 defined therethrough. Each of the auxiliary discharge passages 13 has an inlet port 14 opening into a flow passage 5 in a direction along the axis of the nozzle 6 and located radially outwardly of a bias flow shield 9, and an outlet port opening at an outer peripheral surface of the nozzle body 60' in a direction substantially tangential to a radially outward end surface of a guide wall surface 8, which extends at an angle of $\alpha$ to the axis of the fluid deflecting assembly. The auxiliary discharge passages 13 permit additional air currents to be discharged out from the flow passage 5, thus making up for an air flow loss caused by a restriction surface 7. The additional air currents are also effective in drawing an air flow discharged from a nozzle 6 along the guide wall surface 8, so that the discharged air flow from the nozzle 6 will be securely attached to the guide wall surface 8 under the attraction of the additional air currents.

Figure 12:
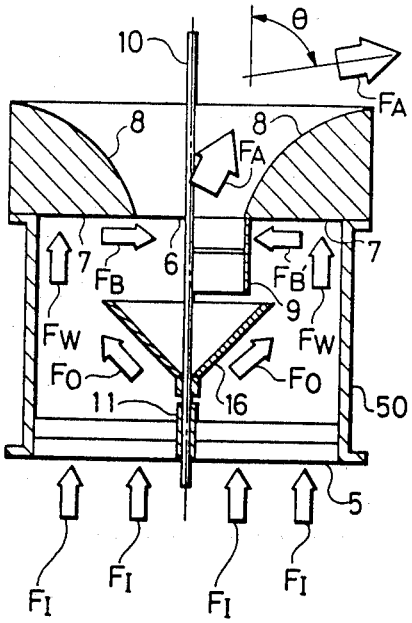
FIG. 12 is a longitudinal cross-sectional view of a fluid deflecting assembly according to a fifth embodiment of the present invention.

FIG. 12 shows a fluid deflecting assembly according to a fifth embodiment of the present invention. In FIG. 12, a conical flow dispersing member 16 is supported on a rotatable shaft 10 and positioned in a flow passage 5 upstream of a nozzle 6 with a tapered end of the conical dispersing member 16 being directed away from the nozzle 6. The conical dispersing member 16 serves to direct central air flows $F_I$ radially outwardly as air flows $F_O$ which hit an inner wall surface of a tubular body 50 and flow as air flows $F_W$. Therefore, almost all air flows $F_I$ going into the tubular body 50 will become bias air flows $F_B$, $F_B'$. Therefore, an air flow $F_A$ discharged from the nozzle 6 results mostly from the bias air flow $F_B$ and is deflected reliably while being well attached to the guide wall surface 8.

In the foregoing embodiments, the bias flow shield is located upstream and radially out of the nozzle and, hence, will not present a resistance to and disturb the air flow through the nozzle. Therefore, the bias flow shield does not reduce the amount of air discharged from the nozzle. The bias flow shield is effective in bringing the discharge air flow into attachment with the guide wall surface to deflect the air flow through a wide angle. Since the bias flow shield is rotatable and axially movable, the discharged air flow can be oriented in various desired three-dimensional directions in a wide angle range. Where the fluid deflecting assembly is incorporated in an outlet port of an air conditioning unit, a discharged air flow can be directed in a wide angle as desired without suffering from any substantial loss in flow rate simply by rotating and/or axially moving the shaft. Therefore, the air conditioning unit incorporating the fluid deflecting assembly is capable of providing highly effective directional control on the discharged air flow in air-conditioning a desired space.

The fluid deflecting assembly may be used in deflecting a flow of fluids other than air, such as water or oil, and therefore will find many applications other than air conditioning units.

Although certain preferred embodiments of the present invention have been shown and described in detail, it should be understood that various changes and modifications may be made therein without departing from the scope of the appended claims.

What is claimed is:

1. A fluid deflecting assembly comprising:

a tubular body having a flow passage for passing therethrough a fluid flow along the axis of said tubular body;

a nozzle body mounted on said tubular body and having a nozzle opening disposed downstream of said flow passage in a direction of the fluid flow, a restriction surface located downstream of said flow passage and surrounding said nozzle opening around said axis, and a guide wall surface extending downstream of said nozzle opening and flaring radially outwardly from said nozzle opening in surrounding relation thereto; and a bias flow shield disposed in said flow passage upstream of said nozzle opening, said bias flow shield having a peripheral edge contoured substantially identically to a portion of a peripheral edge of said nozzle opening for adjustably blocking a portion of a bias fluid flow directed by said restriction surface toward said nozzle opening, said bias flow shield being movable along said peripheral edge of said nozzle opening and in an axial direction of said flow passage.

2. A fluid deflecting assembly according to claim 1, wherein said nozzle is circular in shape and said guide wall surface being conically tapered toward said nozzle opening.

3. A fluid deflecting assembly according to claim 2, wherein said bias flow shield is arcuate in shape and movable along a peripheral edge of said nozzle opening.

4. A fluid deflecting assembly according to claim 2, wherein said bias flow shield is movable spirally in an axial direction of said flow passage.

5. A fluid deflecting assembly according to claim 1, wherein said nozzle opening is polygonal in shape and said guide wall surface is composed of a plurality of different angularly connected surfaces.

6. A fluid deflecting assembly according to claim 5, wherein said bias flow shield comprises a flat plate.

7. A fluid deflecting assembly according to claim 1, wherein said nozzle body has an annular flange extending around said nozzle projecting upstream thereof for fitting engagement with said bias flow shield.

8. A fluid deflecting assembly according to claim 7, wherein said annular flange is disposed radially inwardly of said bias flow shield.

9. A fluid deflecting assembly according to claim 1, wherein said nozzle body has an annular groove extending around said nozzle opening for receiving therein a downstream edge of said bias flow shield.

10. A fluid deflecting assembly according to claim 1, further including a flow dispersing member disposed in said flow passage upstream of said nozzle for directing the fluid flow radially outwardly in said flow pasage.

11. A fluid deflecting assembly according to claim 10, wherein said flow dispersing member is of a conical shape having a tapered end directed away from said nozzle.

12. A fluid deflecting assembly according to claim 1, wherein said nozzle body has at least one auxiliary discharge passage communicating with said flow passage.

13. A fluid deflecting assembly according to claim 12, wherein said nozzle body has a plurality of auxiliary discharge passages each having an inlet port opening into said flow passage in a direction along an axis of said nozzle radially outwardly of said bias flow shield.

14. A fluid deflecting assembly according to claim 13, wherein each of said auxiliary discharge passages has an outlet port opening at an outer peripheral surface of said nozzle body in a direction substantially tangential to a radially outward end surface of said guide wall surface.

* * * * *